US006194986B1

(12) United States Patent
Weatherbee et al.

(10) Patent No.: US 6,194,986 B1
(45) **Date of Patent: *Feb. 27, 2001**

(54) QUICK BOTTOM CONNECTION FOR A TRANSFORMER BUSHING

(75) Inventors: Eric Weatherbee, Attica; William Young; Daxiong Zeng, both of LeRoy, all of NY (US)

(73) Assignee: Lapp Insulator Company, LeRoy, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/184,890

(22) Filed: Nov. 3, 1998

(51) Int. Cl.[7] ..... H01F 27/02; H01R 13/62

(52) U.S. Cl. ..... 336/90; 336/107; 439/310; 174/152 R

(58) Field of Search ..... 336/174, 175, 336/90, 107; 174/DIG. 10, 11 BH, 14 BH, 12 R, 12 BH, 142, 151, 152 R; 439/934, 310

(56) References Cited

U.S. PATENT DOCUMENTS

| | | | | |
|---|---|---|---|---|
| 1,198,018 | * | 9/1916 | Fortescue | 174/DIG. 10 |
| 3,096,392 | | 7/1963 | Shaback . | |
| 3,611,225 | * | 10/1971 | Dakin | 336/58 |
| 3,710,307 | | 1/1973 | Cooper, Jr. . | |
| 3,790,698 | | 2/1974 | Engert . | |
| 3,803,523 | | 4/1974 | Farmer et al. . | |
| 3,861,777 | | 1/1975 | Clark . | |
| 3,926,774 | * | 12/1975 | Watson et al. | 204/667 |
| 4,016,359 | | 4/1977 | Gamble . | |
| 4,339,630 | | 7/1982 | McQuay . | |
| 4,510,477 | * | 4/1985 | Rostron et al. | 336/92 |
| 4,594,475 | * | 6/1986 | Bowman et al. | 174/152 R |
| 4,611,093 | | 9/1986 | Farmer et al. . | |
| 4,767,351 | * | 8/1988 | Patel et al. | 439/363 |
| 4,956,525 | | 9/1990 | Wilk . | |
| 4,965,407 | | 10/1990 | Hamm . | |

* cited by examiner

*Primary Examiner*—Michael L. Gellner
*Assistant Examiner*—Anh Mai
(74) *Attorney, Agent, or Firm*—Nixon Peabody LLP

(57) ABSTRACT

The present invention relates to a transformer includes a housing, a bushing, a core-and-coil unit, an electrical connector, and a connecting rod. The bushing is located in an opening in the housing and comprises a conductive tube surrounded at least partially by an insulating layer. The electrical connector is coupled to the core-and-coil unit in the housing. The connecting rod extends through at least a portion of the conductive tube with one end of the rod being connected to the electrical connector. The connecting rod and the bushing can be moved with respect to each other to electrically couple the electrical connector the conductive tube.

32 Claims, 6 Drawing Sheets

QUICK BOTTOM CONNECTION FOR A TRANSFORMER BUSHING

FIELD OF THE INVENTION

This invention relates generally to a transformer and more particularly to a bushing for a transformer.

BACKGROUND OF THE INVENTION

Typically, a transformer includes a housing which surrounds a core-and-coil unit and has a plurality of openings in which the bushings fit. One end of each bushing is connected to the core-and-coil unit usually near the top of the housing. The inside of the housing is usually filled with a fluid, such as transformer oil. The other end of each bushing which is located outside of the housing through one of the openings is coupled to another conductor, such as a power line. Typically, transformers used by power companies handle voltages ranging between about 15 kV to 765 kV and currents ranging between about 400 and 2000 amps.

One type of bushing is known as a bottom-connected bushing. In a bottom-connected bushing, the transformer windings of a core-and-coil unit are connected directly to the bottom of the conductor for the bushing in the transformer housing. The conductor is fixed within an insulating layer for the bushing.

Another type of bushing is known as a draw-lead bushing. In a draw-lead bushing, the transformer windings of the core-and-coil unit are connected to a flexible cable. The cable is not connected to the bottom of the bushing, but is pulled through a hollow metallic tube that is fixed within the insulating layer for the bushing. The electrical connection is made at the top of the bushing under the top terminal.

Yet another type of bushing is known as a draw-rod or split-conductor bushing. The draw-rod bushing is identical to the draw-lead bushing, except that a solid conductor is used instead of a flexible cable as the conductor. For ease of installation, in some bushings the solid conductor is split in the middle. These bushings are known as split-conductor bushings.

Draw-lead, draw-rod, and split-conductor bushings have limitations in their current carrying capacity because their size is limited by the inside diameter of the hollow metallic tube that is fixed within the insulating layer for the bushing. Typically, bottom-connected bushings can carry more current than draw-rod or split-conductor bushings and draw-rod or split-conductor bushings can carry more current than draw-lead bushings.

The current capacity of a particular bushing is also limited by the temperature rise of the conductor in the bushing. The temperature rise is the result of the heat produced by the resistive losses of the conductor and is greatly affected by the ability of the surrounding media to conduct heat away from the conductor.

One of the problems with bushings is their ability to effectively dissipate heat from the conductor. In the case of bottom connected bushings, the heat can be transferred fairly efficiently to the dielectric material surrounding the conductor. However in the case of draw-lead, draw-rod, and split-conductor bushings, the heat is not transferred as efficiently because the conductor is spaced from the metallic tube which surrounds the conductor by air or other substances. Another problem is the diameter of the conductor is limited by the inside diameter of the metallic tube. As a result, the temperature of the conductor increases, limiting the current carrying capacity of the bushing.

A problem unique to the split-conductor is the contact resistance at the interface between the halves of the split conductor. As a result, the current carrying capacity of the bushing is limited because of the heat produced at the interface.

Another problem with bushings is with their installation and maintenance. There are several instances when one or more bushings may need to be installed into the housing and connected to the core-and-coil unit. For example, when a transformer is initially installed, the transformer is often too bulky to transport to the installation site with the bushings attached. As a result, the bushings are removed and then reinstalled at the installation site. With existing transformers, over time one or more bushings may need to be replaced due to damage or deterioration. Currently, the design of the transformers and bushings makes the process of installing or replacing a bushing in a transformer an expensive and time consuming process.

As discussed above, in many existing designs for transformers the connection point between the bushing and the core-and-coil unit is adjacent the top of the housing of the transformer. Accordingly, to install one or more of these bottom-connected bushings, the transformer oil must be drained from the housing. Once the transformer oil is drained, then a worker must climb inside the housing and connect the bushing to the core-and-coil unit. This connection process is time consuming and expensive.

Additionally, this installation process exposes the interior of the housing to moisture. As a result, the inside of the housing and the core-and-coil unit must be thoroughly dried before the transformer oil is refilled into the housing. The drying process can take a substantial amount of time. By way of example, this drying process typically takes between about one and three days. Accordingly, like the connection process, this drying process is time consuming and expensive and delays the start of actual use of the transformer. Attempts to overcome or minimize these problems have met with limited success.

As discussed above, to improve the installation process, some transformers use draw-lead, draw-rod, and/or split conductor bushings. Basically, one end of the draw lead, draw rod, or split conductor is coupled to the core-and-coil unit near the bottom of the housing. The other end of the conductor is positioned to extend out from the opening in the housing. The tube of insulation for the bushing is simply placed over the conductor which extends up and out of the transformer. These bushings are relatively easy to install, but have other problems as discussed earlier.

SUMMARY OF THE INVENTION

A bushing for a power transformer in accordance with one embodiment of the present invention includes a conductive tube and an insulating layer. The conductive tube has a pair of opposing ends and provides an opening along its length for a connecting rod to extend at least partially through the conductive tube. The conductive tube and the connecting rod are moveable with respect to each other to electrically couple the electrical connector to the conductive tube. The insulating layer surrounds at least part of the conductive tube.

A transformer with a bushing in accordance with another embodiment of the present invention includes a housing, the bushing, a core-and-coil unit, an electrical connector, and a connecting rod. The bushing is located in an opening in the housing and comprises a conductive tube surrounded at least partially by an insulating layer. The electrical connector is coupled to the core-and-coil unit in the housing. The connecting rod extends into at least a portion of the conductive tube with one end of the rod being connected to the electrical connector. The connecting rod and the bushing can be moved with respect to each other to electrically couple the electrical connector the conductive tube.

A method for installing a bushing into a transformer in accordance with another embodiment of the present invention includes providing a connecting rod which is coupled at one end to an electrical connector, inserting the connecting rod into a conductive tube of the bushing, and moving the connecting rod and the conductive tube with respect to each other to electrically couple the electrical connector to the conductive tube.

The present invention provides a number of advantages including providing a bushing with the current carrying capacity of a bottom-connected bushing with the installation advantages of draw-lead, draw-rod, and split-conductor bushings. The bushing in accordance with the present invention has a conductor which can effectively transfer heat to the insulator that surrounds the conductor. These heat transfer properties along with the diameter the conductive tube provides, enable the bushing in accordance with the present invention to carry larger currents than is possible with draw-lead, draw-rod, or split-conductor bushings. Additionally, with the present invention the time consuming and expensive process of draining the transformer oil, connecting the bushings, and then drying the inside of the power transformer is minimized and/or eliminated. The bushing can be installed easily from outside of the housing with fewer workers and in less time than with prior designs.

DETAILED DESCRIPTION

Figure 1:
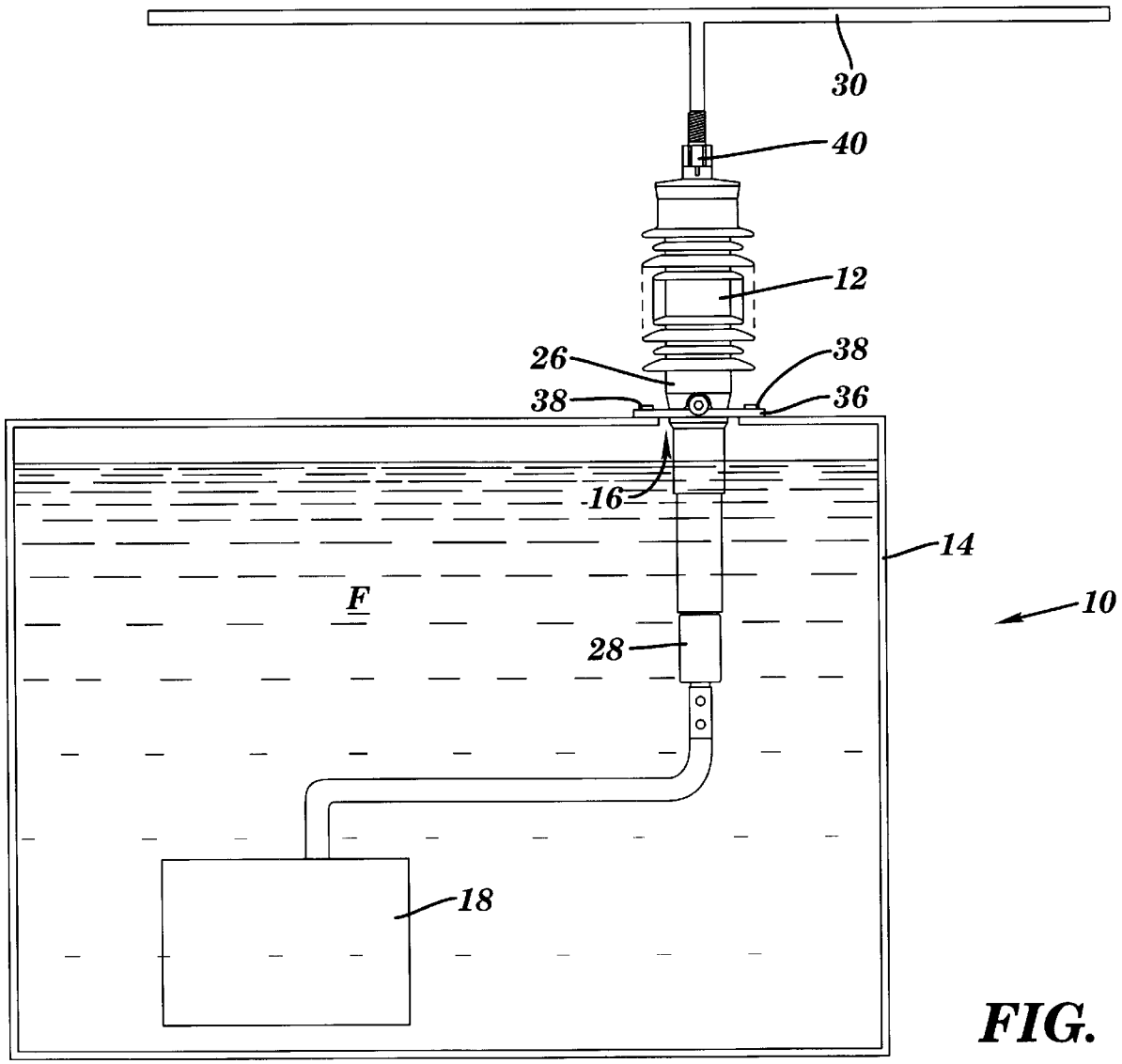
FIG. 1 is a partially cross-sectional view of a power transformer with a bushing in accordance with one embodiment of the present invention connected to power lines.

A transformer 10 with a bushing 12 in accordance with one embodiment of the present invention is illustrated in FIGS. 1–2. The transformer 10 includes a housing 14 with an opening 16, a core-and-coil unit 18, an electrical connector 20, and a connecting rod 22 and the bushing 12 includes a conductive tube 24, an insulating layer 26, and at least one terminal 28. The transformer 10 with the bushing 12 provides a number of advantages including providing a bushing 12 with the current carrying capacity of a bottom-connected bushing with the installation advantages of draw-lead, draw-rod, and split-conductor bushings.

Referring to FIG. 1, the transformer 10 includes the housing 14 with the opening 16 which is designed to receive the bushing 12. Although in this particular embodiment the transformer 10 only has one bushing 12 and one opening 16, the transformer 10 and housing 14 can have more openings and bushings as needed or desired. The core-and-coil unit 18 is located in the housing 14. Since core-and-coil units are well-known to those of ordinary skill in the art, they will not be described in detail here. Typically, the housing 14 is filled with a fluid F, such as transformer oil. The bushing 12 couples the core-and-coil unit 18 to an external conductor 30, such as power lines.

Figure 2A:
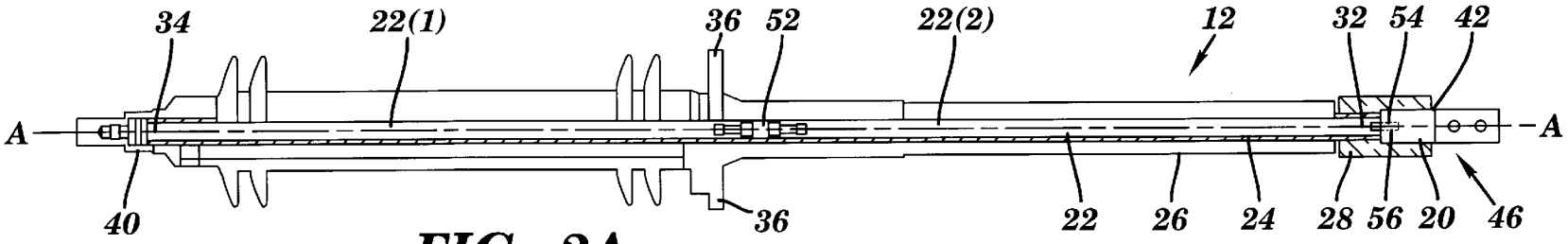
FIG. 2A is a partially perspective and partially cross-sectional view of a bushing in accordance with one embodiment of the present invention.
Figure 2B:
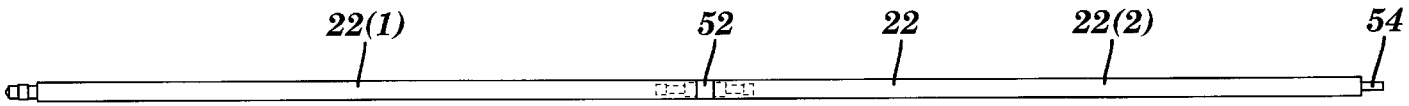
FIG. 2B is a perspective view of a connecting rod used in the bushing shown in FIG. 2A.
Figure 2D:
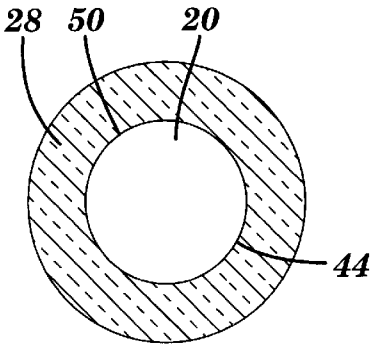
FIG. 2D is a cross-sectional end view of one terminal at one end of the bushing and the electrical connector taken along lines 2D—2D in FIG. 2C.
Figure 2C:
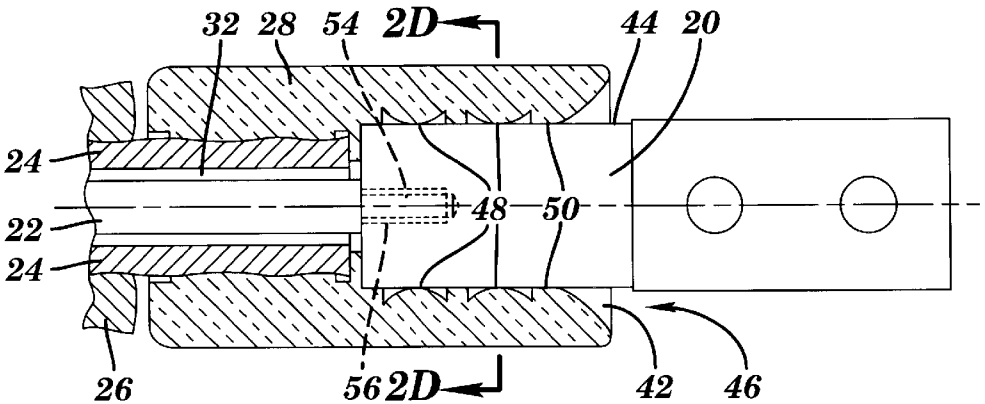
FIG. 2C is a an enlarged, cross-sectional view of a lower portion of the bushing shown in FIG. 2A.

Referring to FIGS. 2A and 2C, the bushing 12 includes a conductive tube 24 which extends along a substantial portion of the length of the bushing 12 and along a first axis A—A. The conductive tube 24 is hollow and has an opening 32 and 34 located at each end. In this particular embodiment, the conductive tube 24 is made of copper, although other types of conductive materials such as aluminum can be used. Because of the larger cross-sectional size and better heat dissipation properties of conductive tube 24 and because the conductive tube 24 is surrounded by the dielectric insulating layer 26 the conductive tube 24 can handle larger currents than prior bushings with draw-leads, draw-rods, or split-conductors. By way of example only, in this particular embodiment a conductive tube 24 for a 15 kV to 69 kV rated bushing has an outer diameter of about 1½" and a wall thickness of about 5/16" and can handle current ranging between about 1200 and 1500 amps and a conductive tube for a 115 kV to 765 kV rated bushing has an outer diameter of about 3" and a wall thickness of about ½" and can handle currents ranging between about 1200 and 2000 amps.

Referring to FIGS. 1, 2A, and 3D–3F, the bushing 12 also includes the insulating layer 26 which partially surrounds the conductive tube 24. The insulating layer 26 must be able to withstand the maximum temperature produced when the conductive tube 24 is carrying the maximum rated current for that core 24. In this particular embodiment, the insulating layer 26 is made of oil impregnated paper or epoxy, although other types of insulating materials such as air, oil, or a dielectric fluid can be used.

The bushing 12 also has a mounting flange 36 which protrudes out from the bushing 12. The mounting flange 36 defines a larger area than the opening 16 in the housing 14. When the bushing 12 is installed into the opening 16 in the housing 14, the mounting flange 36 extends out past the opening 16 and holds a portion of the bushing 12 outside of the housing 14. Securing devices 38, such as screws or bolts, are used to secure the mounting flange 36 to the housing 14 around the opening 16.

Referring to FIGS. 1, 2A, 2C, 2D and 3C–3F, the bushing 12 also has a pair of optional terminals 28 and 40 which are coupled to opposing ends of the conductive tube 24. One terminal 40 is located outside of the housing 14 and couples the conductive tube 24 to another conductor 30, such as the power lines.

Figure 2E:
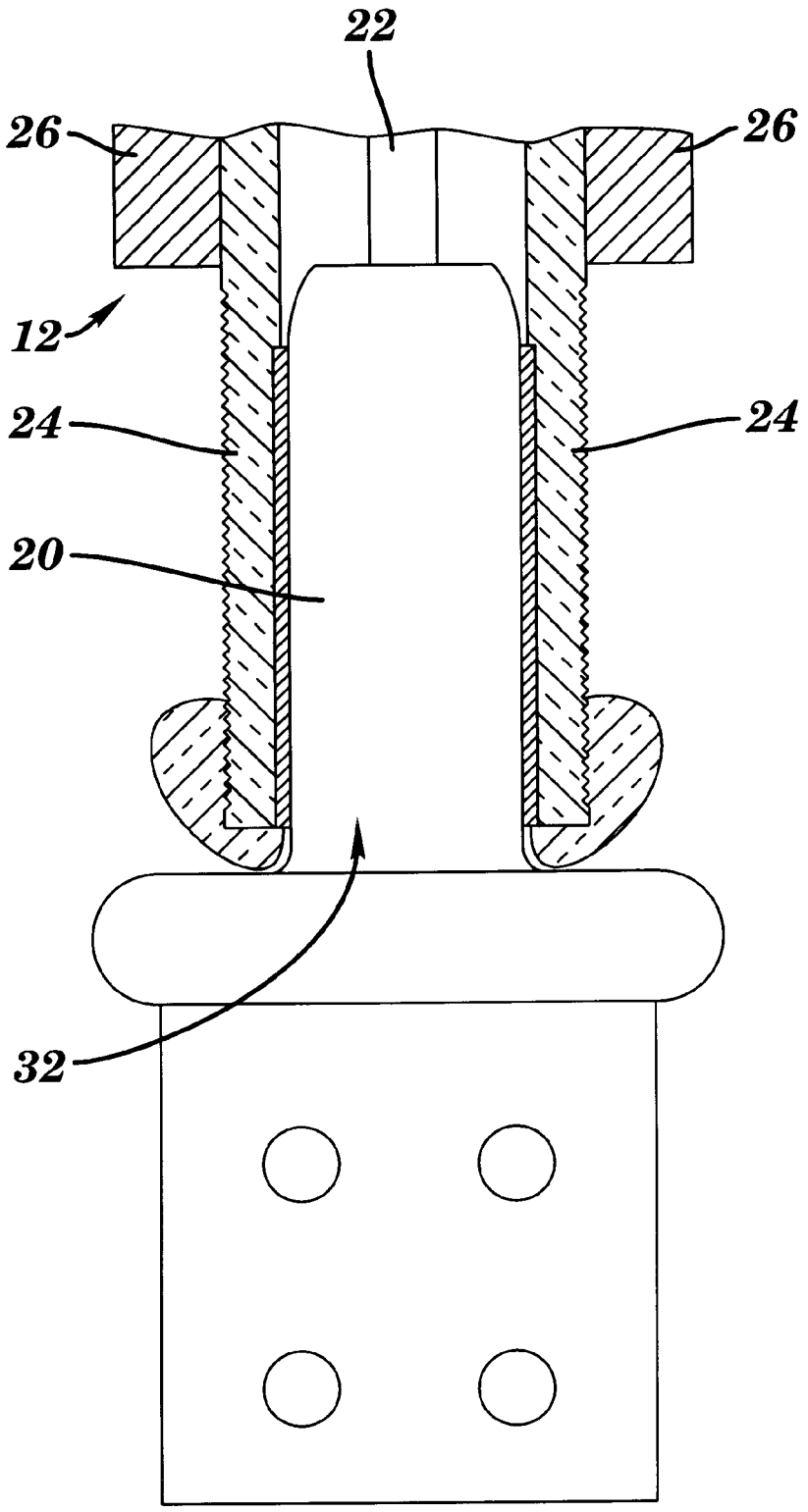
FIG. 2E is a cross-sectional view of a bushing in accordance with another embodiment of the present invention.
Figure 2F:
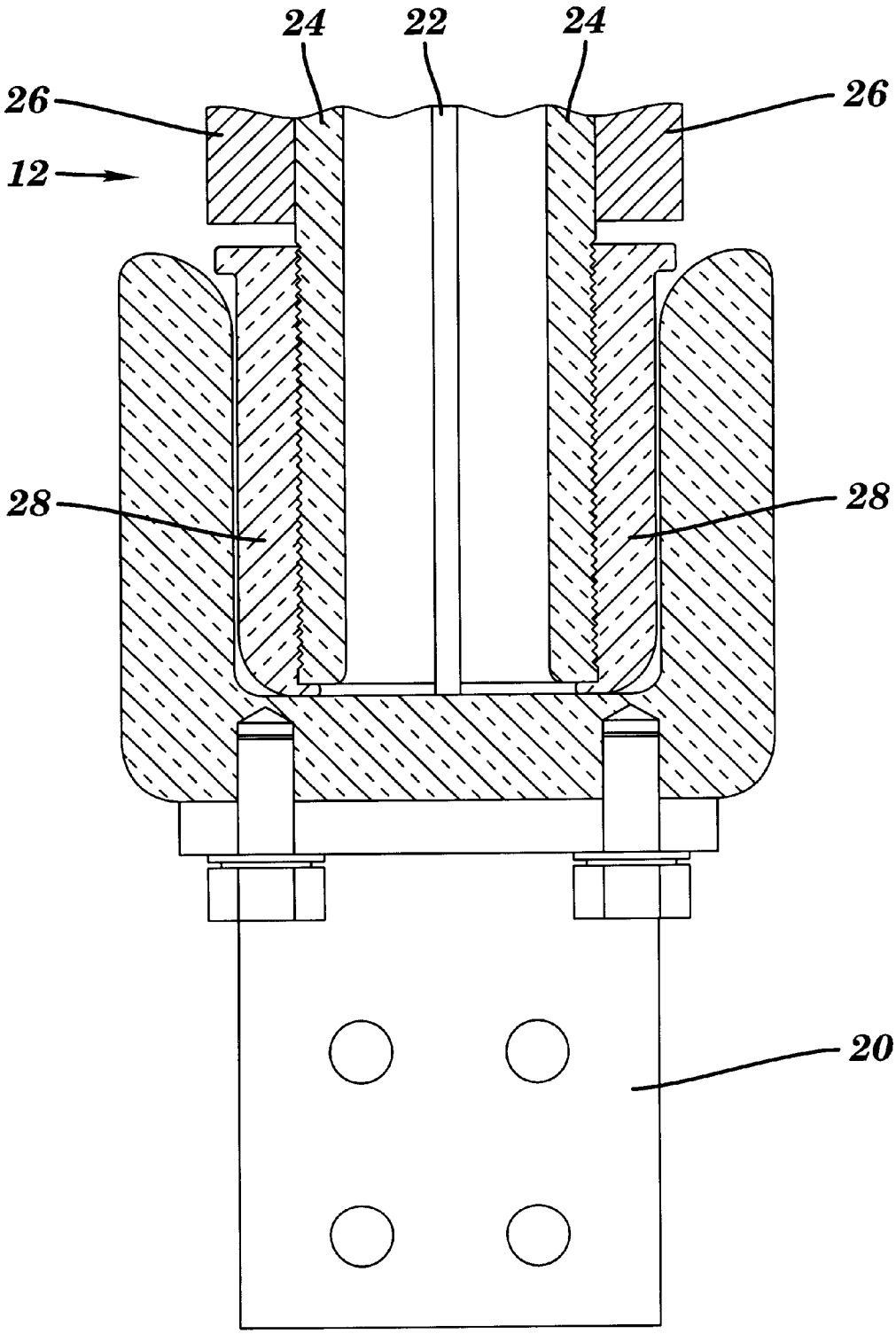
FIG. 2F is a cross-sectional view of a bushing in accordance with yet another embodiment of the present invention.

In this particular embodiment, the other terminal 28 is seated over a portion of the outer surface of the conductive tube 24 in a male-female type connection, although other types of connecting arrangements between the terminal 28 and conductive tube 24 can be used as needed or desired. One end 42 of the terminal 28 is left open to define a space 46 to receive the electrical connector 20. In this particular embodiment, the inner surface of the terminal 28 around the space 46 has a substantially circular shape, although it could have other shapes, such as hexagonal, square, or triangular, as long as the space 46 has a shape that can mate with the outer shape of the electrical connector 20. Although in this particular embodiment, the electrical connector 20 is shown mating inside the terminal 28, other types of connecting arrangements could be used. For example, the electrical connector 20 could be mated directly with one end of the conductive tube 24 a shown in FIG. 2E. Additionally, although in this particular embodiment, the electrical connector 20 is shown mating inside of the end of the terminal 28 or inside the end of the conductive tube 24 in an alternative embodiment, other types of connecting arrangements can be used. For example, the electrical connector 20 could be connected over the end of the terminal 28 or over the end of the conductive tube 24 as shown in FIG. 2F.

Referring to FIGS. 2A and 2C, in this particular embodiment, the inner surface 44 of the terminal 28 around the space includes a plurality of optional contact enhancing devices 48 which protrude in towards the center of the space 46 and frictionally engage with the electrical connector 20 to hold the terminal 28 and electrical connector 20 together. Although contact enhancing devices 48 are shown on the inner surface 44 of the terminal 28 around the space 46, the contact enhancing devices 48 could be located on the outer surface 50 of the electrical connector 20. The contact enhancing devices 48 help to lower the contact resistance. In this particular embodiment, the contact enhancing devices 48 are ribs, although other types and numbers of contact enhancing devices could be used. Additionally, the number of contact enhancing devices 48 can vary as needed or desired or can be completely eliminated.

Referring to FIGS. 2A–2C, and 3A–3D, the connecting rod 22 extends through and along at least a portion of the conductive tube 24 and substantially along axis A—A. In this particular embodiment, the connecting rod 24 comprises two parts or sections 22(1) and 22(2) , although the connecting rod 22 could be just one piece or more than two pieces as needed or desired. Connecting or securing devices 52, such as nuts and bolts or matching male and female connectors, are used to connect one end of one section 22(1) to another end of the other section 22(2). One section 22(1) protrudes out of the opening 16 of the housing 14 and the other section 22(2) protrudes into the housing 14. The other end of the section 22(2) which protrudes into the housing 14 is connected to an electrical connector 20. In this particular embodiment, the other end of the section 22(2) has a threaded portion 54 which mates with a matching threaded opening 56 in the electrical connector 20 although other types of connections could be used. The connecting rod 22 can be made from a non-conductive or a conductive material. If the connecting rod 22 is made of a conductive material, the connecting rod 22 may also be used to carry some current with the conductive tube 24. One of the advantages of the present invention is that the connecting rod 22 rather than the conductive tube 24 is split in half. As a result, since the conductive tube 24 is not split, it does not have the same problem with contact resistance experienced by prior bushings with the split-conductor design.

Referring to FIGS. 2A, 2C, and 3A–3D, the electrical connector 20 is coupled to the core-and-coil unit 18 in the housing 14. The electrical connector 20 has an outer shape which is designed to mate with a space 46 in one end of the terminal 28 or in an alternative embodiment in an opening 32 at one end of the conductive tube 24. In this particular embodiment, the outer surface of the electrical connector 20 has a substantially circular shape, although the electrical connector 20 could have other shapes, such as hexagonal, square or triangular, as long as the outer surface 50 of the electrical connector 20 has a shape that can mate with the space 46 in one end of the terminal 48 or in an alternative embodiment in an opening 32 at one end of the conductive tube 24.

The bushing 12 in accordance with the present invention can be easily installed into or replaced in a transformer 10 while still maintaining the current carrying characteristics of a prior bottom-connected bushing. By way of example, the process for initially installing a bushing 12 into a transformer 10 will be discussed below.

Figure 3C:
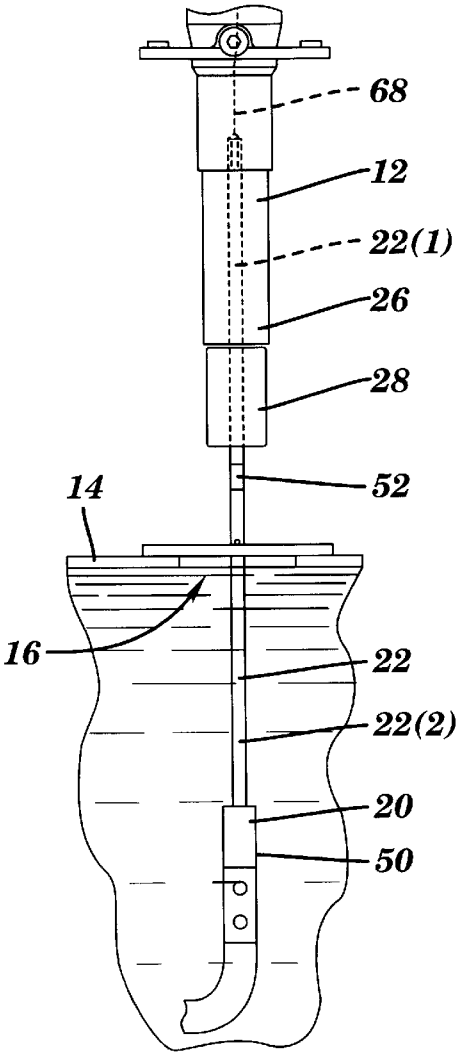
FIGS. 3A–3F are perspective views illustrating an installation of a bushing in a power transformer in accordance with one embodiment of the present invention.
Figure 3B:
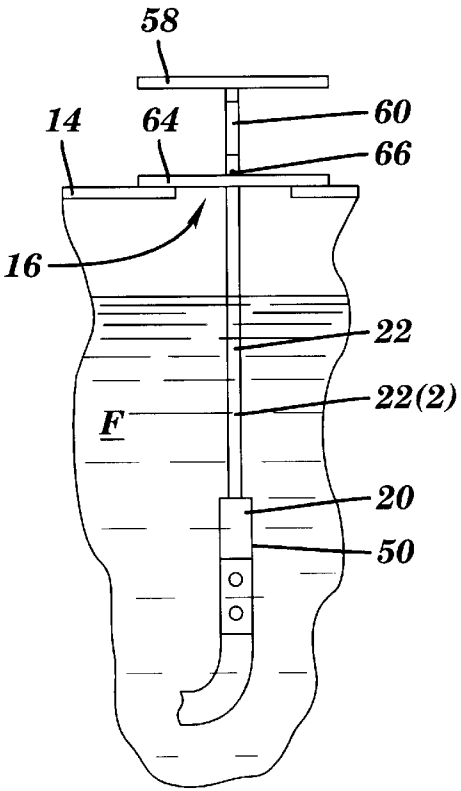
Figure 3A:
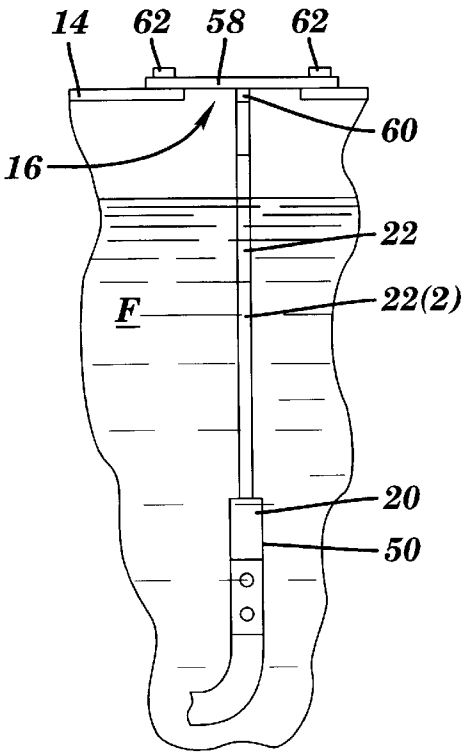

Referring to FIG. 3A, initially during transport of the transformer 10 to the installation site, a shipping plate 58 is secured to the housing 14 over the opening 16. The shipping plate 58 helps to prevent moisture and other contaminants from getting into the housing 14. One end of one section 22(2) of the connecting rod 22 is connected to an extension 60 which is connected to the shipping plate 58.

Once the transformer 10 is at the installation site, then the shipping plate securing devices 62 which connect the shipping plate 58 to the housing 14 are removed. The shipping plate 58 is lifted away from the housing 14 to which pulls the connecting rod 22 up and partially out of the opening 16 in the housing 14 and exposes the opening 16. As shown in FIG. 3B, a split plate 64 is then placed over the opening 16 and around the portion of the section 22(2) of the connecting rod 22 which extends through the opening 16. A safety pin 66 is installed into the section 22(2) of the connecting rod 22 to support the shipping plate 58 and a portion of the connecting rod 22 away from the housing 14.

Referring to FIG. 3C, once the safety pin 66 is installed, then the extension 60 and the shipping plate 58 are disconnected from the end of the section 22(2). Next, the end of the section 22(2) is connected to the end of another section 22 (1) of the connecting rod 22 by a securing device 52. The other section 22(1) of the connecting rod 22 is then inserted into the space 46 in the terminal 28 and into the conductive tube 24 of the bushing 12. A connector wire or cable 68 is coupled to the other end of the section 22(1) and helps to hold the connecting rod 22 in place in the terminal 28 and conductive tube 24. The safety pin 66 is then removed and the split plate 64 disconnected from the housing 14 to expose the opening 16.

Figure 3F:
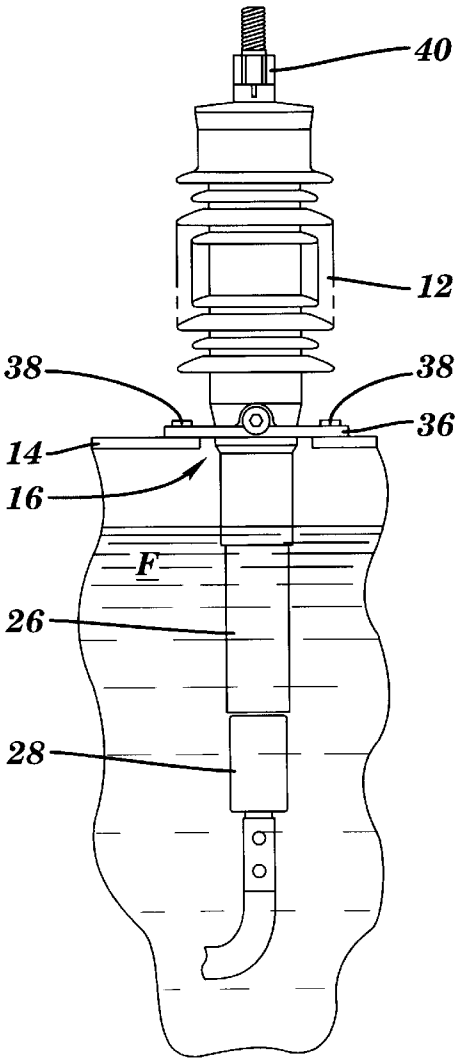
Figure 3E:
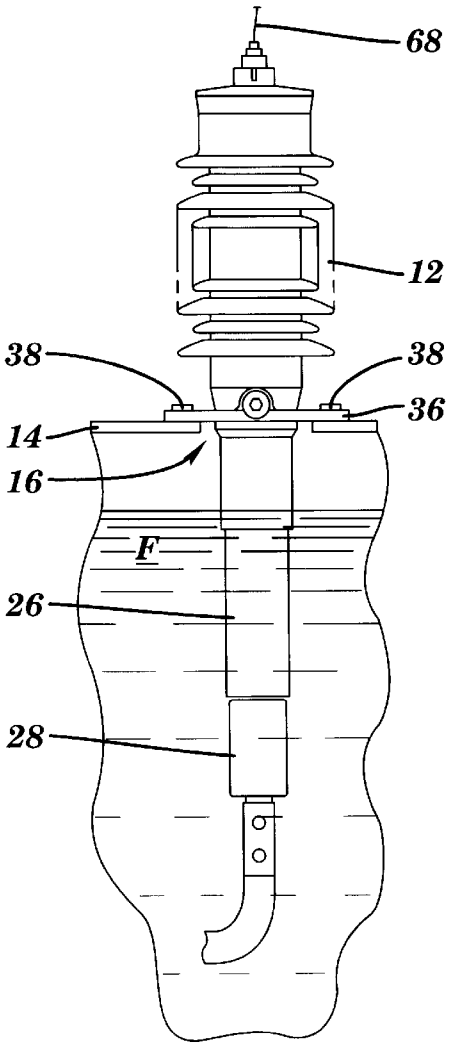
Figure 3D:
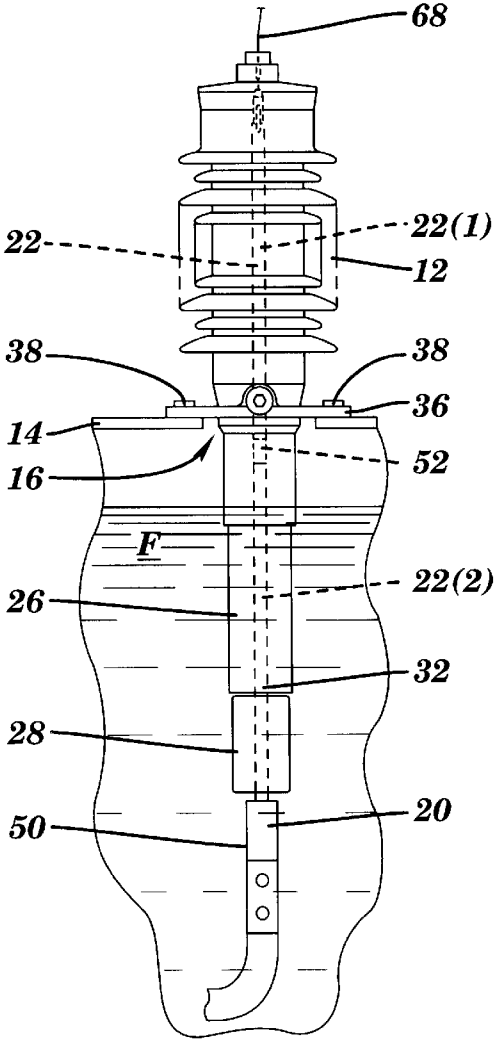

Referring to FIG. 3D, once the split plate 64 has been removed, then the bushing 12 is partially lowered into the housing 14 until the mounting flange 36 rests on the housing 14 around the opening 16. The mounting flange 36 is connected to the housing 14 about the opening 16 with securing devices 38, such as screws or bolts.

Referring to FIG. 3E, once the bushing 12 is secured to the housing 14, the connecting rod 22 is drawn further into the conductive tube 24 which pulls the electrical connector 20 into the space 46 in the terminal 28 which mates and electrically couples the electrical connector 20 to the terminal 28 and to the conductive tube 24. As shown in FIG. 2C, the inner surface 44 of the terminal 28 in the space 46 in this particular embodiment includes a plurality of ribs 48 which frictionally engage with the outer surface 50 of the electrical connector 20 and help to maintain the connection. As discussed earlier, other types of connecting and coupling arrangements can be used, such as pulling the electrical connector 20 into an opening 32 at one end of the conductive tube 24 instead of the space 46 in the terminal 28 or pulling the electrical connector 20 over the end of the terminal 28 or over the end of the conductive tube 24 as shown in FIGS. 2E and 2F. After the rod is pulled through the bushing, it is secured with a pin, snap-ring, or other device. A nut or terminal is installed to make the electrical connection.

Referring to FIGS. 1 and 3F, once the electrical connector 20 has been pulled into the space 46 in the terminal 28, the other terminal 40 is connected to the other end of the conductive tube 24. The other terminal 40 is then coupled to another external conductor 30, such as a power line.

As this installation process illustrates, the present invention provides a bushing 12 which can be installed into a transformer 10 with the ease of a draw-lead, draw-rod, or spilt-conductor bushing with the current carrying capacity of a bottom-connected bushing. There is no need with the present invention to drain the fluid F from the transformer 10 to connect the bushing 12 to the core-and-coil unit 18 and there is no need to get into a transformer 10 housing filled with fluid F to connect sections of a bushing together. Additionally, the present invention minimizes the amount of time that the housing 14 is open and exposed to moisture and other contaminants. As a result, the time consuming and expensive process of drying the inside of a transformer housing 14 is minimized and/or eliminated.

Although not described, the process for replacing a bushing 12 is the same, except that the existing bushing 12 must first be disconnected by reversing the steps described with reference to FIGS. 3C–3F, i.e. basically disconnect the top terminal 40, push the electrical connector 20 out of the space 46 in the end of the terminal 28, disconnect the mounting flange 36 from the housing 14, attach the split plate 64 and safety pin 66, and pull off the old bushing 12 from the sections 22(1) and 22(2) of the connecting rod 20. Once the old bushing 12 has been removed, the steps described with reference to FIGS. 3C–3F are simply repeated to install a new bushing 12.

Having thus described the basic concept of the invention, it will be rather apparent to those skilled in the art that the foregoing detailed disclosure is intended to be presented by way of example only, and is not limiting. Various alternations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A bushing for a transformer with a connecting rod connected at one end to a mating end of an electrical connector, the electrical connector coupled to a core-and-coil unit in a housing, the bushing comprising:

a conductive tube with a pair of opposing ends and providing a space for the connecting rod, the connecting rod moveable to a first position to slidably mate and electrically couple the mating end of the electrical connector to one end of the conductive tube and to a second position to slidably disconnect the mating end of the electrical connector from the one end of the connective tube; and an insulating layer which surrounds at least part of the conductive tube.

2. The bushing as set forth in claim 1 wherein the one end of the conductive tube has an opening which receives the mating end of the electrical connector.

3. The bushing as set forth in claim 1 further comprising a plurality of contacting enhancing portions on a surface of the one end of the conductive tube, the contacting enhancing portions frictionally engaging with a surface of the mating end of the electrical connector.

4. The bushing as set forth in claim 3 wherein the contacting enhancing portions are ribs.

5. The bushing as set forth in claim 1 further comprising a plurality of contacting enhancing portions on a surface of the mating end of the electrical connector, the contacting enhancing portions frictionally engaging with a surface on the one end of the conductive tube.

6. The bushing as set forth in claim 5 wherein the contacting enhancing portions are ribs.

7. The bushing as set forth in claim 1 further comprising a first terminal connected to the one end of the conductive tube, the first terminal having an opening which receives the mating end of the electrical connector.

8. The bushing as set forth in claim 7 further comprising a plurality of contacting enhancing portions on a surface of the terminal in the space, the contacting enhancing portions frictionally engaging with a surface of the mating end of the electrical connector.

9. The bushing as set forth in claim 8 wherein the contacting enhancing portions are ribs.

10. The bushing as set forth in claim 7 further comprising a plurality of contacting enhancing portions on a surface of the mating end of the electrical connector, the contacting enhancing portions frictionally engaging with a surface of the terminal.

11. The bushing as set forth in claim 10 wherein the contacting enhancing portions are ribs.

12. A transformer comprising:

a housing with at least one opening;

a bushing located in the opening, the bushing comprising a conductive tube surrounded at least partially by an insulating layer;

a core-and-coil unit in the housing;

an electrical connector coupled to the core-and-coil unit, the electrical connector having a mating end; and a connecting rod extending through at least a portion of the conductive tube with one end of the rod connected to the mating end of the electrical connector, the connecting rod moveable to a first position to slidably mate and electrically couple the mating end of the electrical connector to one end of the conductive tube and to a second position to slidably disconnect the mating end of the electrical connector from the one end of the connective tube.

13. The transformer as set forth in claim 12 wherein the connecting rod comprises a first section and a second section, the first section being connected at one end to one end of the second section by a securing device the other end of the second section connected to the electrical connector.

14. The transformer as set forth in claim 12 wherein the connecting rod is made of a non-conductive material.

15. The transformer as set forth in claim 12 wherein the connecting rod is made of a conductive material.

16. The transformer as set forth in claim 12 further comprising a first terminal connected to the one end of the conductive tube, the first terminal having an opening which receives the mating end of the electrical connector.

17. The transformer as set forth in claim 16 further comprising a second terminal connected to an opposing end of the conductive tube.

18. The transformer as set forth in claim 16 further comprising one or more contact enhancing portions on a surface of the terminal which mates and electrically couples with the electrical connector, the contact enhancing portions frictionally engaging with an outer surface of the electrical connector.

19. The transformer as set forth in claim 18 wherein the contact enhancing portions are ribs.

20. The transformer as set forth in claim 12 further comprising one or more contact enhancing portions on a surface of the electrical connector, the contact enhancing portions frictionally engaging with a surface of the terminal.

21. The transformer as set forth in claim 20 wherein the contact enhancing portions are ribs.

22. The transformer as set forth in claim 12 further comprising a plurality of contacting enhancing portions on a surface of the one end of the conductive tube, the contacting enhancing portions frictionally engaging with a surface of the mating end of the electrical connector.

23. The transformer as set forth in claim 22 wherein the contacting enhancing portions are ribs.

24. The transformer as set forth in claim 12 further comprising a plurality of contacting enhancing portions on a surface of the mating end of the electrical connector, the contacting enhancing portions frictionally engaging with a surface on the one end of the conductive tube.

25. The transformer as set forth in claim 24 wherein the contacting enhancing portions are ribs.

26. A method for installing a bushing into a transformer comprising:

providing a connecting rod which is coupled at one end to a mating end of an electrical connector, the electrical connector is coupled to a core-and-coil unit in a housing;

inserting the connecting rod into a conductive tube for the bushing; and moving the connecting rod to slidably mate and electrically couple the mating end of the electrical connector to one end of the conductive tube.

27. The method as set forth in claim 26 further comprising the step of connecting one end of a first section of the connecting rod to one end of a second section of the connecting rod before inserting the connecting rod into the conductive tube.

28. The method as set forth in claim 26 wherein the step of moving further comprises pulling the mating end of the electrical connector into the one end of the conductive tube with the connecting rod.

29. The method as set forth in claim 26 wherein the step of moving further comprises pulling the mating end of the electrical connector over the one end of the conductive tube with the connecting rod.

30. The method as set forth in claim 26 wherein the step of moving further comprises pulling the mating end of the electrical connector into a space in a terminal connected to the one end of the conductive tube with the connecting rod.

31. The method as set forth in claim 26 wherein the step of pulling further comprises pulling the mating end of the electrical connector over a terminal connected to the one end of the conductive tube with the connecting rod.

32. The method as set forth in claim 26 further comprising securing the bushing to the housing.

* * * * *